US009784084B2

(12) United States Patent
Sun et al.

(10) Patent No.: US 9,784,084 B2
(45) Date of Patent: Oct. 10, 2017

(54) METHOD FOR HEATING OIL SHALE SUBSURFACE IN-SITU

(71) Applicant: Jilin University, Changchun, Jilin Province (CN)

(72) Inventors: Youhong Sun, Changchun (CN); Lopatin Vladimir, Tomsk (RU); Wei Han, Changchun (CN); Martemyannov Sergey, Tomsk (RU); Qiang Li, Changchun (CN); Bukharkin Andrey, Tomsk (RU); Yang Yang, Changchun (CN); Zuoan Yuan, Changchun (CN); Baochang Liu, Changchun (CN); Wei Guo, Changchun (CN); Ke Gao, Changchun (CN)

(73) Assignee: Jilin University, Changchun, Jilin Province (CN)

( * ) Notice: Subject to any disclaimer, the term of this patent is extended or adjusted under 35 U.S.C. 154(b) by 0 days.

(21) Appl. No.: 14/774,874

(22) PCT Filed: Mar. 11, 2014

(86) PCT No.: PCT/CN2014/073202

§ 371 (c)(1),
(2) Date: Sep. 11, 2015

(87) PCT Pub. No.: WO2014/139402

PCT Pub. Date: Sep. 18, 2014

(65) Prior Publication Data

US 2016/0024901 A1 Jan. 28, 2016

(30) Foreign Application Priority Data

Mar. 13, 2013 (CN) ..... 2013 1 0078978

(51) Int. Cl.
*E21B 43/24* (2006.01)
*C10B 53/06* (2006.01)
(Continued)

(52) U.S. Cl.
CPC ..... *E21B 43/2401* (2013.01); *C10B 53/06* (2013.01); *C10G 1/00* (2013.01); *H05B 3/60* (2013.01); *H05B 2214/03* (2013.01)

(58) Field of Classification Search
None
See application file for complete search history.

(56) References Cited

U.S. PATENT DOCUMENTS 2,795,279 A * 6/1957 Sarapuu ..... E21B 43/2401 166/248
3,106,244 A * 10/1963 Parker ..... E21B 43/2401 166/248
(Continued)

FOREIGN PATENT DOCUMENTS

CA 2 560 223 A1 3/2007
CN 87100890 A 8/1988
(Continued)

OTHER PUBLICATIONS

International Search Report for Application No. PCT/CN2014/073202 dated May 28, 2014.

*Primary Examiner* — Anuradha Ahuja
(74) *Attorney, Agent, or Firm* — Jenkins, Wilson, Taylor & Hunt, P.A.

(57) ABSTRACT

A method for heating oil shale underground in situ. Shale oil and fuel gas can be obtained from an underground oil shale seam in situ, and the fuel gas can also be obtained from an underground coal seam in situ. Wells are drilled downwardly reaching an operation region of an underground oil shale ore bed. Electricity for partial discharge of the ore bed is conducted into electrodes, and a plasma channel is formed
(Continued)

in the ore bed and subjected to breakdown by the electricity; after the resistance of each of two electrode regions is lowered, the two electrodes are used for conducting currents into the plasma channel in the oil shale ore bed; the oil shale ore bed is heated under the resistance heating function of the plasma channel; and released heat is used for realizing thermal cracking and gasification of fixed organic carbon in the oil shale ore bed.

4 Claims, 1 Drawing Sheet

(51) Int. Cl.
*C10G 1/00* (2006.01)
*H05B 3/60* (2006.01)

(56) References Cited

U.S. PATENT DOCUMENTS 3,137,347 A * 6/1964 Parker ..... E21B 43/2401 166/248
3,428,125 A * 2/1969 Parker ..... E21B 43/2401 166/248
3,642,066 A * 2/1972 Gill ..... E21B 43/2401 166/248
3,696,866 A * 10/1972 Dryden ..... E21B 43/2401 166/248
3,848,671 A * 11/1974 Kern ..... E21B 43/24 166/248
3,862,662 A * 1/1975 Kern ..... E21B 43/2401 166/248
4,046,194 A * 9/1977 Cloud ..... E21B 43/2401 166/248
4,067,390 A * 1/1978 Camacho ..... E21B 36/02 166/272.1
4,084,638 A 4/1978 Whiting
4,193,451 A 3/1980 Dauphine
5,626,726 A * 5/1997 Kong ..... C10G 15/12 204/172
7,331,385 B2 2/2008 Symington et al.
7,669,657 B2 3/2010 Symington et al.
9,347,302 B2 5/2016 Kaminsky
2005/0150688 A1* 7/2005 MacGregor ..... B23K 10/00 175/16
2007/0193744 A1 8/2007 Bridges
2008/0236817 A1* 10/2008 Tillman ..... E21B 36/02 166/251.1
2013/0255936 A1* 10/2013 Geilikman ..... E21B 43/26 166/248
2015/0167440 A1* 6/2015 Kasevich ..... E21B 33/124 166/52

FOREIGN PATENT DOCUMENTS

CN 101558216 A 10/2009
CN 101636555 A 1/2010
CN 103 174 406 A 6/2013
CN 103 306 654 A 9/2013
RU 2 102 587 C1 1/1998
RU 2349745 C2 3/2009
RU 2385412 C1 3/2010

* cited by examiner

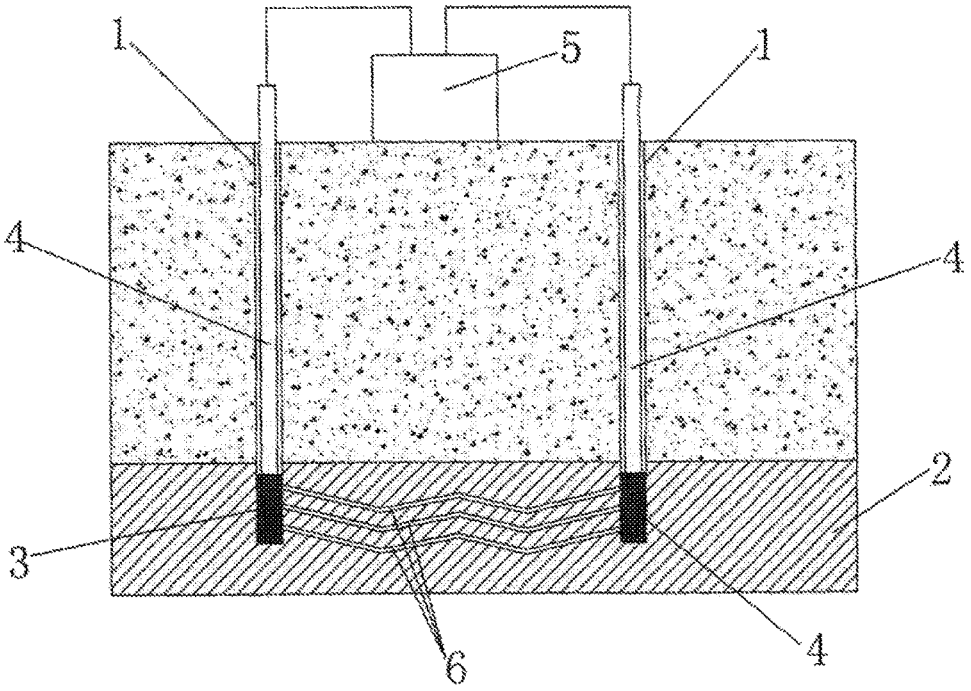
1
5
1
4
4
2
3
6
4

METHOD FOR HEATING OIL SHALE SUBSURFACE IN-SITU

CROSS-REFERENCE TO RELATED APPLICATIONS

This application is a continuation of PCT patent application number PCT/CN2014/073202, filed Mar. 11, 2014, which claims the benefit of and priority to Chinese Patent Application No. 201310078978.5, filed Mar. 13, 2013, the disclosures of each of which are incorporated herein by reference in their entirety.

TECHNICAL FIELD

The present invention relates to exploitation technology of oil shale, and especially to a method for heating oil shale subsurface in-situ, which method may be used to obtain shale oil and gas fuel, i.e., combustible gas, from oil shale in-situ, and to obtain fuel gas from coal bed in-situ.

BACKGROUND ART

At present, the existing method for gasifying coal or oil shale subsurface is to execute the steps of drilling wells, penetrating, igniting, blasting air and drawing the product air. The disadvantage of the said method is that the obtained fuel gas has a relatively low caloric value, since a large amount of stabilizing gas that is generated when organic substances combusts in the underground gasification region blends with fuel gas. That method has been disclosed in the Russian patent NO. 2385412, with the Patent Classification No. МПК E21MB43/295.

Another known method is as follows: drilling at least one well until its depth penetrates through the seam working region; creating at least one crack penetrating through the well; filling the crack with an electrically-conductive material and inserting two electrodes therein; making the electrodes in contact with the electrically-conductive material; electrifying the electrodes so that electric current in the crack flows partially or entirely along the electrically-conductive material; and thereby by using the resistance heat-releasing function of the electrically-conductive material, releasing sufficient heat for effecting thermolysis of given organic substances in the seam. The disadvantage of the said method lies in the complex process and great construction intensity, and further the conductive material may be toxic, thereby polluting the environment and underground water. That method has been disclosed in the Russian patent NO. 2349745, with the Patent Classification No. МПК E21B43/24.

The U.S. Pat. No. 4,084,638 discloses a method of production stimulation and enhanced recovery of oil. The method comprises drilling at least two wells downwardly from the ground surface, putting electrodes into the wells respectively, conducting high voltage into the electrodes to crush the oil shale, and heating the oil shale by means of the resistance thermal effect of the seam. In the method, the high voltage only achieves the shocking function to create cracks in the oil shale, thereby forming passages in the oil shale for facilitating flow of the oil and gas. During this process, the oil shale appearance undergoes a change, a kind of simple physical change. In addition, during the process of executing the method, shocking is independent of electrical heating, and these two steps will not have an effect on each other. The method mainly has the following technical effects: creating the cracks by means of shocking to improve the flow passage of the oil and gas, improving flowability of the oil and gas via heating, and thereby increasing the recovery rate of the oil and gas. The method also can be described as a means for improving exploitation of the presently existing oil and gas reservoir.

Shell Group of Companies developed electric heating technology, ICP technology for short, and Mahogany research engineering of Shell has been always dedicated to renovating the Shell conversion technology in-situ. Shell filed the patent application "Method for Producing Oil by Heating Oil Shale" on Jan. 17, 1987, with the filing No. 87100890 and publication No. CN87100890A. The disclosed principle is as follows: inserting the electrical heaters into the well, and normally heating the oil shale away from the ground surface by 300-600 m. The rock formation is slowly heated to 400-500° C., and kerogen in the oil shale is converted into crude oil and rock gas. Then the products (crude oil and rock gas) are suctioned upwardly onto the ground by using the conventional exploiting method.

In comparison to the conventional ground dry distillation treatment, the slow heating at the relatively low temperature in-situ obviously reduces the carbon emissions. The ICP process of Shell brings about approximately ⅓ rock gas and ⅔ light crude oil, and the produced rock gas is subjected to power generation or sale. Shell Group of Companies has proved that the ICP process requires less than three barrels of water for producing one barrel of crude oil or equivalent.

Exxon Mobil Corporation filed the patent application No. 200880009037.3 on Mar. 7, 2008 entitled "Resistive Heater for in situ Formation Heating", with the publication No. CN10163655A. The disclosed technology is as follows: fracturing oil shale by hydraulic power, pouring a conductive material into the crack to form a heating portion, and heating oil shale in-situ by means of dielectric resistance. Here is the principle: creating vertical crack in the horizontal well, filling the crack with conductive media to obtain a conductive region, heating shale oil to the thermolysis temperature through the conductive region, and producing crude oil and rock gas that can be withdrawn by the conventional oil production technology.

Exxon Mobil Corporation filed the patent application No. 200780046031.9 on Oct. 10, 2007 entitled "Enhanced Shale Oil Production by in situ Heating using Hydraulically Fractured Producing Wells", with the publication No. CN101558216A. The fracturing technology was previously regarded as the most attractive technique among more than thirty standby solutions by the Exxon Mobil Corporation, and linear thermal conduction in the planar heat reservoir of the heating body possibly is the most effective approach for entrance of ore-rich layer and for achieving conversion to the crude oil and rock gas. According to the experiences offered by Exxon, the planar heater needs less heating wells and occupies less area in comparison to the wellhole heater. The in-situ technique owned by Exxon Mobil Corporation possibly also needs to take measures to avoid intrusion of formation water, and to prevent formation water from being polluted by the formed carbohydrates and other components. In this regard, a great deal of power is needed for use in heating.

Radiation heating technique: RF/CF technique of Raytheon Corporation.

Such in-situ technology employs radio-frequency and injection of supercritical carbon dioxide for heating oil shale to thermolysis temperature, so as to drive the liquid and gas into the production well. On the ground surface, the carbon dioxide fluid is separated and again injected into the production well, and at the same time the oil and gas are refined into gasoline, fuel oil and other products. Such extracting technology just requires several months for producing oil and gas, while several years by other in-situ methods. The said technology can adjust the heat energy applied to the object layer to produce the various products. Like the ICP process of Shell, the RF/CF technique also consumes a great deal of power for forming the radio-frequency energy. According to the experiences offered by Raytheon Corporation, use of such technique can produce 4-5 barrels of crude oil or equivalent by consuming the energy of one barrel of crude oil.

CONTENTS OF THE INVENTION

The object of the present invention is to provide an effective and environmentally-friendly method for heating oil shale subsurface in-situ, and the present invention is involved with improvements to the Russian patent No. 2349745. The claimed method can effectively reduce the construction difficulty and cost by forming a plasma channel resulting from the breakdown of the high electricity in the seam and then conducting electric current into the plasma channel for heating, so as to effect pyrolysis and gasification of organic carbon. Use of the method will not pollute underground water, being environmentally-friendly and non-toxic.

The method of the present invention comprises the following: drilling wells downwardly from the ground surface until the depth of the wells reaches the working areas of the underground oil shale seam; drilling at least two wells and putting electrodes in the wells; firstly applying a high voltage that is enough to make the oil shale seam partially discharge to the electrodes, thus forming a plasma channel resulting from the breakdown of the high electricity in the oil shale seam; conducting electrical current, through the two electrodes, into the plasma channel resulting from the breakdown of the high electricity in the oil shale seam, after the resistance between the two electrode areas is reduced; heating the oil shale seam through the resistance heating function of the plasma channel; and realizing pyrolysis and gasification of given organic carbon in the oil shale seam by using the heat released.

The present invention is distinguished from the Russian patent No. 2349745 by the following aspects.

The present invention applies the relatively high voltage to the electrodes so that it is sufficient to achieve the partial electric discharge and the dendritic conduction, thereby creating the breakdown of the high electrical energy in the oil shale seam and hereby forming a plasma channel. After the plasma channel is formed, the resistance between the two electrode areas is decreased, and electrical current also flows through the plasma channel in the oil shale seam, thereby heating the oil shale seam by means of the resistance heat of the oil shale seam itself.

In terms of the method disclosed in Russian patent No. 2349745, it only applied when the low-voltage power supply is used for heating the oil shale seam, and the conductive material that has been injected into the oil shale seam is used as the resistor for heating.

The present invention exhibits the following advantageous effects: effectively reducing the construction quantities, no fracturing the oil shale seam, and avoiding use of the toxic conductive material.

DESCRIPTION OF THE FIGURES

FIG. 1 is a schematic diagram of the present invention.

MODE OF CARRYING OUT THE INVENTION

Referring to FIG. 1, the method of the present invention comprises the following: drilling two wells 1 downwardly from the ground surface until the depth of the wells reaches the working areas of the underground oil shale seam 2; putting electrodes 3 in the wells; connecting the electrodes 3 to a power supply 5 on the ground via cables 4; firstly applying a high voltage that is enough to lead to the partial electric discharge to the electrodes 3, thus forming plasma channels 6 resulting from the breakdown of the high electricity in the oil shale seam 2; conducting electrical current, through the two electrodes 3, into the plasma channels 6 in the oil shale seam 2, after the resistance between the two electrode 3 areas is reduced; heating the oil shale seam 2 through the resistance heating function of the plasma channels 6; and realizing pyrolysis and gasification of given organic carbon in the oil shale seam 2 by using the heat released.

Here are the principles of the present invention.

The given organic carbon has a very great resistance, i.e., $10^8$-$10^{12}$ ohm/cm, and thus under the conventional situation, the resistance heat in the rock is very weak. High voltage alternating current is conducted between the electrodes 3, and heating is made via dielectric loss which gives rise to the partial electric discharge. An electrically-conductive region is formed between the discharge working sections, and the electrically-conductive region will be further extended and enlarged via the next discharge effect, so as to finally form a dendritic discharge structure, extending from one electrode to the other electrode in a dendritic structure. That is, the plasma channels resulting from the electrothermal breakdown are formed. During this phrase, it is necessary to apply the relatively high voltage to the electrodes so as to effect the partial electric discharge. The specific magnitude of the voltage depends on the distance between the electrodes and the type and structure of the rocks, and can be determined by means of experiments on the rock sample. When carrying out the experiments, the partial electric discharge can be observed by naked eyes or through the change in the electrical current on the ondoscope. Formation of the plasma channels resulting from the electrothermal breakdown can be determined via the decrease in the resistance between the electrodes. The voltage is approximately 1-10 KV/m, i.e., application of the voltage of 1-10 KV for every interval of one meter. The frequency of the current has no great effect on formation of the dendritic plasma channels resulting from the electrothermal breakdown, and the alternating current with industrial-frequency can be therefore used. After the plasma channels resulting from the electrothermal breakdown are formed, the linear resistance between the electrode regions will be decreased up to 10-100 ohm/cm. Formation of the plasma channels resulting from the electrothermal breakdown can be determined by monitoring the voltage and current between the electrodes.

After the plasma channels from the electrothermal breakdown are formed, the electrodes should be connected to a DC power of high current or AC power of high current. That is, after the plasma channels from the electrothermal breakdown are formed, the power supply of the electrodes is switched into the DC power of high current or AC power of high current, and heating is made by using the resistance effect of the plasma channels resulting from the electrothermal breakdown, and the power supply under the heating mode has a voltage of 10-100V/m and current of 10-100 A.

The oil shale seam may be replaced by coal mine seam, that is, the method of the present invention is applicable to heating coal mine seam subsurface in-situ.

Embodiment 1

In the laboratory, the experiments are executed by using oil shale samples, and the distance between the electrodes is set to be 50 cm. Prior to the experiment, the resistance value between the electrodes is 250K ohm. When executing the experiment, alternating current having the frequency of 50 Hz and peak voltage of 5 KV is conducted into the electrodes. It can be found by visual observation that phenomena of the partial electric discharge occur at that voltage. The power consumption of the power supply is about 300 W. This process lasts for 30 minutes, and during the time period of 30 minutes, the plasma channels from the electrothermal breakdown are gradually formed. The resistance between the electrodes changes to 800 ohm. Subsequently, the current with the frequency of 50 Hz flows through the electrodes, and heating is made by using the resistance thermal effect of the low-resistance channels. At the beginning, the voltage is maintained at the level of several hectovolts, and its resistance is reduced to about 10 ohm with the continuous heating for the channels. At this moment, the voltage also is reduced to 100V in order to ensure the 1 KW power.

Embodiment 2

In the laboratory, the experiments are executed by using lignite samples, and the distance between the electrodes is set to be 45 cm. Prior to the experiment, the resistance value between the electrodes is 150K ohm. When executing the experiment, alternating current having the frequency of 50 Hz and peak voltage of 8 KV is conducted into the electrodes. It can be found by visual observation that phenomena of the partial electric discharge occur at that voltage. The power consumption of the power supply is about 600 W. This process lasts for 15 minutes, and during the time period of 15 minutes, the plasma channels from the electrothermal breakdown are gradually formed. The resistance between the electrodes changes to 300 ohm. Subsequently, the current with the frequency of 50 Hz flows through the electrodes, and heating is made by using the resistance thermal effect of the low-resistance channels. At the beginning, the voltage is maintained at the level of several hectovolts, and its resistance is reduced to about 3-5 ohm with the continuous heating for the channels. At this moment, the voltage also is reduced to 60V in order to ensure the 1 KW power.

It has been proved by the above experiments that the method of the present invention has the advantages of effectively reducing the construction quantities, no hydraulically fracturing the rock stratum, and avoiding use of the toxic conductive material.

The invention claimed is:

1. A method for heating oil shale subsurface in-situ, which comprises:

drilling at least two wells downwardly from a ground surface until depths of the at least two wells reach working areas of an underground oil shale seam;

putting an electrode in each of the at least two wells;

firstly applying an alternating current voltage having a magnitude selected to cause a partial electric discharge to the electrodes, thus forming plasma channels resulting from an electrothermal breakdown in the oil shale seam;

after the plasma channels from the electrothermal breakdown are formed, conducting electrical current into the plasma channels in the oil shale seam through the electrodes in two of the at least two wells, after resistance between the electrodes in the two of the at least two wells is reduced;

wherein the conducting comprises applying a direct current or an alternating current between the electrodes in the two of the at least two wells having a current magnitude selected to cause resistance heating of the oil shale seam through a resistance heating function of the plasma channels; and realizing pyrolysis and gasification of organic carbon in the oil shale seam by the heating.

2. The method for heating oil shale subsurface in-situ as claimed in claim 1, characterized in that the applying an alternating current voltage comprises applying a 1-10 kV alternating current voltage per meter of distance between the electrodes to lead to the partial electric discharge; and the heating, after the plasma channels from the electrothermal breakdown are formed, comprises applying a voltage in a range of 10-100 V per meter of distance between the electrodes and current in a range of 10-100 A.

3. A method for heating a coal mine seam subsurface in-situ, which comprises:

drilling at least two wells downwardly from a ground surface until depths of the at least two wells reach working areas of an underground coal mine seam;

putting an electrode in each of the at least two wells;

firstly applying an alternating current voltage having a magnitude selected to cause a partial electric discharge to the electrodes, thus forming plasma channels resulting from an electrothermal breakdown in the coal mine seam;

after the plasma channels from the electrothermal breakdown are formed, conducting electrical current into the plasma channels in the coal mine seam through the electrodes in two of the at least two wells, after a resistance between the electrodes in the two of the at least two wells is reduced;

wherein the conducting comprises applying a direct current or an alternating current between the electrodes in the two of the at least two wells having a current magnitude selected to cause resistance heating of the coal mine seam through a resistance heating function of the plasma channels; and realizing pyrolysis and gasification of organic carbon in the coal mine seam by the heating.

4. The method for heating a coal mine seam subsurface in-situ as claimed in claim 3, characterized in that the applying an alternating current voltage comprises applying a 1-10 kV alternating current voltage per meter of distance between the electrodes to lead to the partial electric discharge; and the heating, after the plasma channels from the electrothermal breakdown are formed, comprises applying a voltage in a range of 10-100 V per meter of distance between the electrodes and current in a range of 10-100 A.

* * * * *